US006311597B1

(12) United States Patent
Schroth et al.

(10) Patent No.: US 6,311,597 B1
(45) Date of Patent: Nov. 6, 2001

(54) SELF-GUIDING PUNCH AND DIE SET

(75) Inventors: Michael Schroth, Mullica Hill; Thomas Rooney, Oaklyn, both of NJ (US)

(73) Assignee: Humdinger, Inc., Philadelphia, PA (US)

( * ) Notice: Subject to any disclaimer, the term of this patent is extended or adjusted under 35 U.S.C. 154(b) by 0 days.

(21) Appl. No.: 09/317,468

(22) Filed: May 24, 1999

(51) Int. Cl.[7] ..... B26D 5/08; B21J 13/04; B30B 1/00

(52) U.S. Cl. ..... 83/531; 83/533; 83/558; 83/588; 83/613; 83/821; 83/520; 72/456; 100/266

(58) Field of Search ..... 100/266, 215, 100/196; 72/456, 434, 433, 445; 83/533, 540, 531, 556, 557, 558, 569, 588, 582, 613, 821, 520

(56) References Cited

U.S. PATENT DOCUMENTS

| | | | | |
|---|---|---|---|---|
| 1,581,680 | * | 4/1926 | Gueritey | 72/435 X |
| 1,780,817 | | 11/1930 | Dubois . | |
| 1,942,930 | * | 1/1934 | Ludington | 72/434 X |
| 2,108,253 | | 2/1938 | Dense . | |
| 2,213,451 | * | 9/1940 | Munschauer et al. | 83/533 X |
| 2,325,990 | | 8/1943 | Wales . | |
| 2,336,982 | | 12/1943 | Cremer . | |
| 3,254,550 | | 6/1966 | McDonald . | |
| 3,472,109 | * | 10/1969 | Haas et al. | 83/540 |
| 3,534,441 | * | 10/1970 | Johanson | 100/266 X |
| 3,648,600 | * | 3/1972 | Jaccard | 100/266 X |
| 3,661,039 | | 5/1972 | Lewis . | |
| 3,690,207 | * | 9/1972 | McCabe | 100/266 X |
| 3,709,083 | * | 1/1973 | Doherty | 83/588 X |
| 3,724,311 | * | 4/1973 | Streich et al. | 100/266 X |
| 3,861,192 | | 1/1975 | Suzuki et al. . | |
| 4,596,131 | | 6/1986 | Stehr et al. | 72/456 |
| 4,945,954 | | 8/1990 | Wehrly, Jr. et al. . | |
| 5,375,932 | | 12/1994 | Hanaway | 384/49 |
| 5,463,892 | | 11/1995 | Nakagawa | 72/456 |
| 5,666,870 | | 9/1997 | Enomoto et al. | 83/824 |

FOREIGN PATENT DOCUMENTS

| | | |
|---|---|---|
| 1108545 | 7/1953 | (DE) . |
| 2040742 | 8/1970 | (DE) . |
| 62-267027 | 11/1987 | (JP) . |

* cited by examiner

*Primary Examiner*—Boyer Ashley
*Assistant Examiner*—Charles Goodman
(74) *Attorney, Agent, or Firm*—Duane Morris

(57) ABSTRACT

A punch and die set is provided for use in a stamping press having a punch assembly and a die assembly reciprocated by a driving mechanism. The punch and die assemblies are aligned to a common center and are structured to slidably engage one another for positive guidance of the punch and die tools without the need for other guidance by shafts, bars or the like. One of the punch assembly and die assembly can be non-fixedly carried by the drive mechanism, allowing the guidance of the engaged punch and die assemblies to define the relative positions of the tools. This arrangement eliminates any stack-up of tolerances between the assemblies and substantially reduces misalignment during stamping, including any misalignment that may be introduced by the press driving mechanism.

20 Claims, 10 Drawing Sheets

SELF-GUIDING PUNCH AND DIE SET

BACKGROUND OF THE INVENTION

1. Field Of The Invention

The invention relates to metal forming and stamping machines in which opposed punch and die tools are brought together on a malleable work piece such as a length of sheet metal. According to an aspect of the invention, cooperating tools such as a punch and complementary die are carried on opposed tool carrying structures that are independently complementary, namely being engaged with one another around a periphery for guidance in a male-female guiding arrangement that precisely and repeatably determines the relative positions of the punch and die tools as they are brought together at the work piece in the stamping operation.

2. Prior Art

In a conventional technique for the manufacture of certain articles, particularly from flat strips of metal, blank stock is fed into a specially manufactured tool called a stamping press, which carries a stamping die. The stamping die and other associated structures have shaped forming edges and surfaces that respectively support or strike the stock. Through the pressure and motion of the device, the tool cuts out and/or forms the stock into the metal parts or components of the required size and shape.

The stamping press has driving elements that impart the necessary motion and tonnage to force the flat metal strip into the desired shape in conjunction with the tool structures, typically moving one of two interengaging tools in an oscillatory displacement against an opposed tool which is mounted on a stationary support. Typically the motion involves the vertical oscillation of a forming tool against a fixed tool on a horizontal bed. One or a number of forming operations can be accomplished in a stroke, plural operations being accomplished by placing tools configured for successive forming steps laterally adjacent to one another along a feed path of the stock.

Stamping presses are available in a wide variety of sizes and capabilities, depending upon the size and complexity of the required parts, as are the tools. Stamping presses can produce small parts at very high rates, and may operate at over 3,000 vertical strokes per minute. Metal stamping dies are used to manufacture parts ranging from very small and/or sophisticated components for the electronics industry, to large shapes such as portions of an automotive body.

Metal stamping dies typically comprise two associated halves, which together are referred to as a "punch and die set." A conventional punch and die set has an upper shoe and a lower shoe to which the metal forming tools are mounted, and guide posts and bushings for holding the upper and lower shoes, and therefore the tools, in precise alignment during die construction, die maintenance, die setting and in use to form parts.

The number of guide posts and bushings varies according to the accuracy required and the size of the die set. In a typical vertically-oriented stamping die, the upper half of the stamping die holds a punch-set, and is usually the portion that is attached to the movable part of the stamping press, known as a "ram." The ram moves the punch-set up and down relative to the lower half of the stamping die (referred to as the die-set), which is stationary on a heavy bolster plate defining a fixed bed. Metal stamping dies perform different processes upon the flat metal strip, depending on the configuration of the surfaces that contact the work piece. The processes include, without limitation, coining, drawing, blanking, piercing, notching, embossing, and similar types of bending, forming and cutting operations, etc. The tools that perform the foregoing processes require machining and mounting to very precise tolerances. For example, to cut through the work piece an appropriate clearance between passing edges of the punch and die tools might be less than two tenths of one thousandth of an inch. Depending on the thickness of the stock and other parameters, a relatively wider clearance between the same passing edges may not cut through the stock at all, and instead will bend or draw the stock without parting it. For dependable correct operation, the dimensions and relative positions of the punch and die tools can be critical. In addition, a lack of sufficient clearance, or even contact between punch and die portions that are intended to pass one another, can wear or destroy the punch and die sets.

The tolerances can be very demanding. A punch and die set is preferably capable of being precisely opened and closed and will correctly form parts repeatedly, for hundreds of thousands of successive strokes of the stamping press. The punch and die set structures must be precisely and accurately positioned in the stamping press and the movable and stationary parts of the press that carry the punch and die sets must be moved precisely and accurately to ensure that the punch and die structures meet and/or pass in the exact same relative position each and every time the stamping press cycles. This is necessary to prevent the stamping die from damaging itself as well as to correctly form the parts.

There are potential problems associated with punch and die sets that can cause finished part quality problems and punch and die set tool damage. A very reliable, extremely precise, and accurate alignment design is required in order to ensure that a stamping die is always correctly aligned. If a punch and die set is not aligned correctly, for whatever reason, expensive damage will occur. For example, punch tools and die sections can chip or break, or excessive wear of the tools will occur, necessitating frequent stoppages for maintenance.

On the other hand, the press driving and guiding structures must be heavy and durable if they are to survive a large number of operations. It can be all the more difficult to ensure accurate and repeatable motion in very heavy driving arrangements needed for durability and longevity. With these needs in mind, various methods have been employed in the prior art to prevent or reduce misalignment of punch and die tools.

Known stamping dies and presses typically comprises planar supporting structures such as a movable rectangular plate on the punch side and a stationary horizontal bed or support for the die. Driving mechanisms bring the supporting structures together relative to one another in a direction normal to the parallel planes of the movable plate and the bed. For guidance, the punch and die sets are usually connected, respectively, to the ram and to the bed or base of the stamping press and to one another, including by two, three or four vertical guide posts, for example at the corners of the punch and die set. The posts can be fixed in one of the movable and stationary sides and movable in an opening in the other. These vertical posts also can be configured in a male/female elongated arrangement with the top or punch-posts fitting over or inside the lower die-posts. p Both the stamping press and punch and die set depend upon the guide posts for alignment of the punch tools with the die tools, and the punch and die set with the stamping press ram. A number of guide posts are provided at positions spaced laterally from one another, defining a line along which the movable and stationary members come together, and fixing the relative orientation of the movable and stationary members as well.

A punch and die set may have inherent alignment problems due to their shape. For a punch and die set to make a viable component, the top half (e.g., the punch) must meet the bottom half (die) in a nearly perfectly parallel orientation (usually level horizontal). If, for example, one corner is lower than another, the angular error results in a corresponding side-to-side or front-to-back lateral error in the relative positions of interacting punch and die surfaces and edges. Even the slightest difference in angular relationship between the punch and die may damage the metal forming tools or result in poor quality parts.

A four-post die, punch and die alignment is considered appropriate to maintain relative positions and to prevent uneven closing of the punch and die set. The posts are typically located at or near the periphery of the bed, such as at the corners of a rectangular bed. In this arrangement, the guiding interactions of the individual posts are well spaced from one another, which spreads the guiding effect of the posts and tends to provide more positive support than a closer array or fewer guide posts. However, each post involves a limited mass of material and has a relatively small surface area in contact with the bore in the opposed structure or the like. The posts and their bores can wear at different rates, for example due to die imbalance or uneven buildup of grease and dirt along each post. Furthermore, with wear, the plates can tend to move out of a parallel orientation and become canted. This can cause uneven performance of the stamping die as well as an increased rate of wear on the guiding mechanism, resulting in increasingly poor or variable quality in the stamped parts.

Apart from the aspect of angular error between the punch and die set, the overall alignment of the press can vary and negatively affect the performance of the punch and die set, particularly where highly demanding tolerances are involved. For example, if the press ram has incurred an angular error, the thrust vector for the ram's vertical motion is not exactly perpendicular to the base of the press, this error in the alignment of operative forces is likewise translated to the punch and die set.

Prior art designers have developed methods of loosely suspending a punch and die set from the ram to eliminate a direct angular error. This improvement in alignment separates the matter of press alignment form punch/die plate alignment but has other drawbacks. Substantial complexity must be added to the punch and die arrangement, and even greater reliance for structural support and alignment is placed on the four guide posts. Thus suspending the punch to relieve ram alignment sensitivity may introduce angular errors by increasing wear and reliance on the guide posts. As a practical matter, this concept works only if every other component is in excellent condition and operates perfectly, and the press is only out of alignment by a minor span, such as a few thousandths of an inch. Such circumstances rarely occur in normal manufacturing.

Press manufacturers also have attempted to add dimensional stability and/or to reduce alignment errors by adding margins of safety to the various die and punch components. These efforts add cost and complexity to the punch and die.

Improvements in the prior art to improve the alignment of punch and die sets with time and wear, have added substantially to the complexity of an already complicated technology. The practical improvement in accuracy has been modest by comparison. There is a need in the art to reduce or eliminate angular alignment errors and improve positioning accuracy, without adding substantial complexity to the structure of dies and presses. Conversely, there is a need for a less complicated and expensive arrangement for punch and die sets that is at least as accurate for punch/die positioning, and preferably is more accurate, than the conventional structure in which a plurality of spaced guide posts constrain the relative motion of the punch and die and their carrying structures.

SUMMARY OF THE INVENTION

The invention provides a punch and die set for use in a stamping press, comprising a self-guiding punch assembly and die assembly, eliminating stack-up of the tolerances associated with cooperative assemblies and substantially reducing misalignment during stamping.

In one embodiment, the punch assembly includes at least one tool that is adapted for engaging and altering a work piece such as a strip of metal, a punch shoe arranged to hold the tool on a first side and for operative engagement with a portion of the stamping press on a second side, with the first and second sides having a common center or reference. A stripper guide bushing surrounds and encloses the punch shoe so that the punch shoe and the stripper guide bushing are both symmetric about the common center or reference. The die assembly is disposed in coaxial confronting relation to the punch shoe, and includes a die nest having at least one through-bore that is sized and shaped to receive the tool, and a die nest guide bushing surrounding and enclosing the die nest. The die nest guide bushing is symmetric about the same common center or reference as the punch shoe, and is dimensioned relative to the punch shoe and the stripper guide bushing such that, when the punch and die set are mounted and assembled in a stamping press, the die nest guide bushing slidingly receives the punch shoe and the stripper guide bushing. The die nest guide bushing is rigidly fixed on one of the relatively movable members of the stamping press and positively guides the punch shoe and stripper guide bushing, which are fixed to the other of the movable members of the press, over the full stroke of the stamping press.

BRIEF DESCRIPTION OF THE DRAWINGS

The features and advantages of the invention are more fully disclosed in, or rendered apparent by, the following detailed description of certain preferred embodiments of the invention, which are to be considered together with the accompanying drawings wherein like numbers refer to like parts, and wherein.

DETAILED DESCRIPTION OF THE PREFERRED EMBODIMENT

The following description of preferred embodiments of the invention is intended to be read in connection with the foregoing drawings and should be considered a portion of the entire written description of this invention. As used in the description, terms such as "horizontal, " "vertical," "left," "right," "up" and "down," etc., are intended to refer to orientations illustrated in particular drawing figures and the like and do not limit the invention to particular orientations. Similarly, terms such as "inwardly" and "outwardly" generally refer to the orientation of a surface relative to its axis of elongation, or axis of rotation, as appropriate. Also, terms such as "coupled," "connected" or "interconnected" are intended to describe a relationship between two or more structures, mean that such structures are secured or attached relative to each other either directly or indirectly through intervening structures and includes pivotal connections. The term "operatively" means that the foregoing direct or indirect connection between the structures allows such structures to operate as intended by virtue of such connection.

Figure 1:
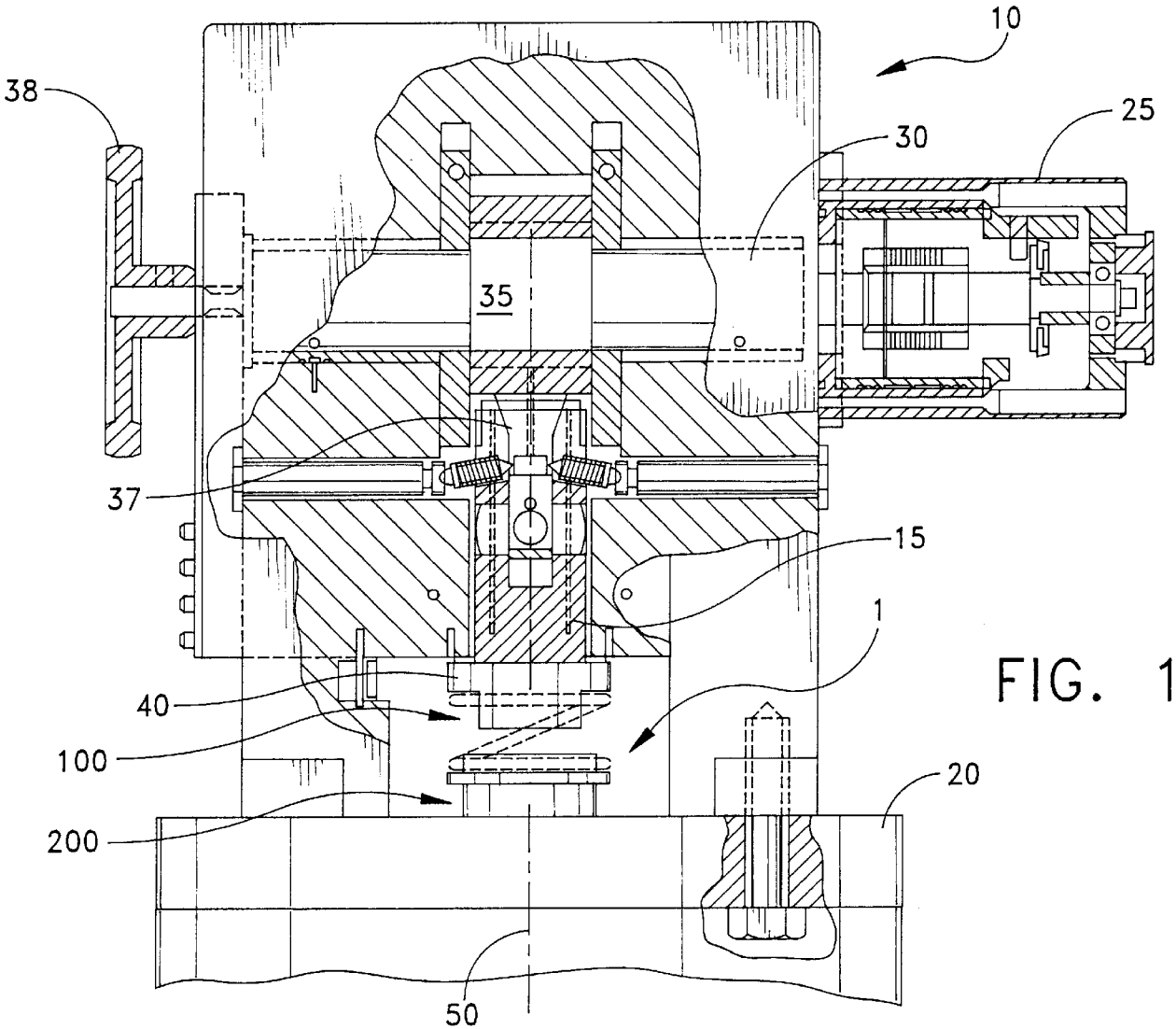
FIG. 1 is a front elevational view of a stamping press including a punch and die set in accordance with the subject invention.

FIG. 1 shows a self-guiding punch and die set 1 structured in accordance with the invention, installed for use in a stamping press 10 of a type that apart from the invention is conventional in the art. Stamping press 10 includes a ram 15 coupled to a drive operable to move ram 15 toward and a away from a bolster plate 20, for example at a rate in the range from approximately 5 to 5,000 strokes per minute. The length of the stroke may be in the range from about 0.5 to 10 inches. An electric motor 25 is coupled to a drive shaft 30 having an eccentric 35 which drives ram 15 by means of a crank 37. A flywheel 38 stores kinetic energy from electric motor 25 and assists in moving ram 15 toward and away from bolster plate 20. Drive shaft 30 and crank 37 can be journaled in hydrostatic bearings and ram 15 likewise can be journaled in a linear hydrostatic bearing, including fluid conduits, all of which are designed to allow stamping press 10 to operate at the above-mentioned 5 to 5,000 strokes per minute. An upper tooling mount 40 is attached to and carried by ram 15, via through-bores in mount 40 and bolts or the like (not shown).

Figure 2:
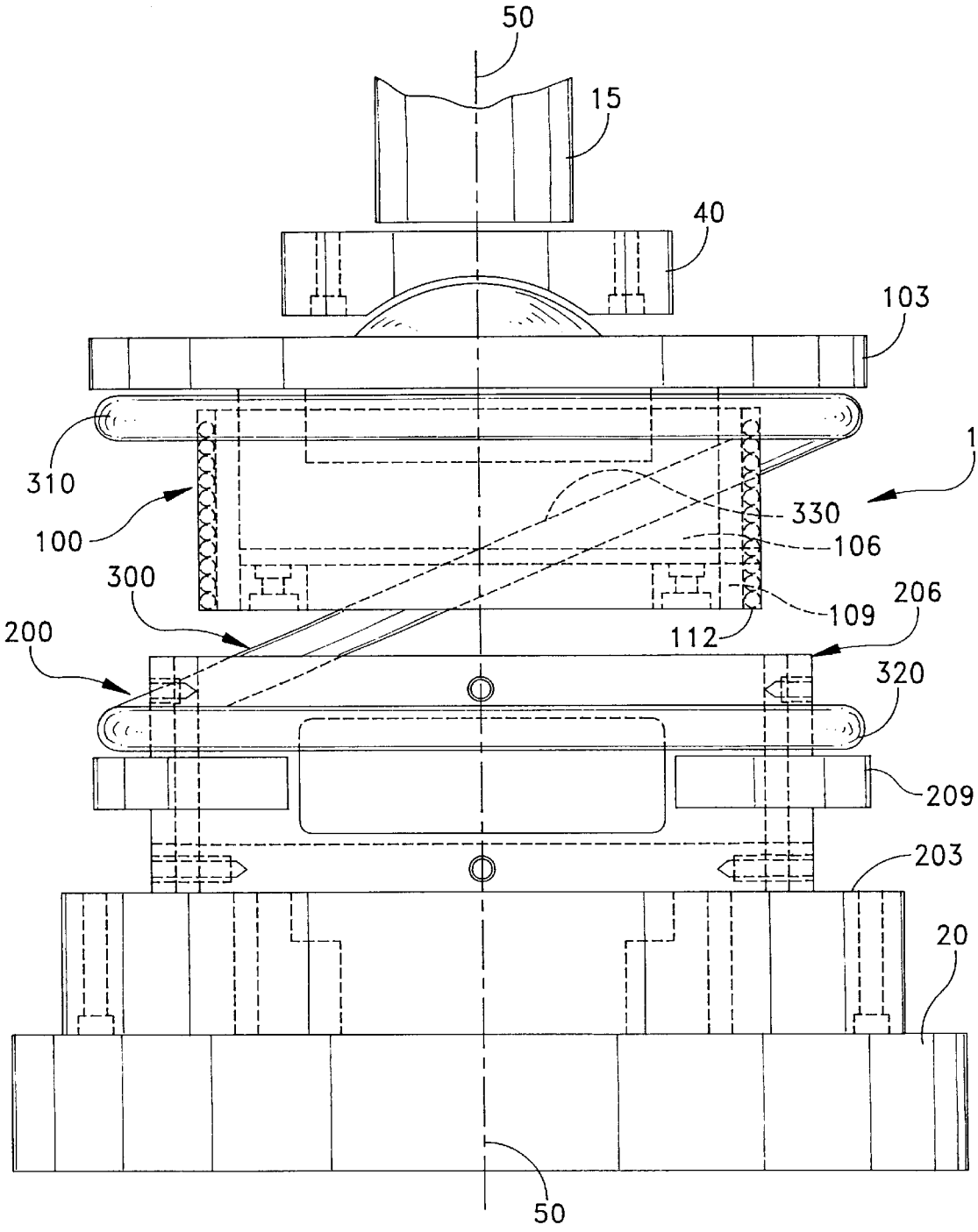
FIG. 2 is a front elevational view, partially in phantom, of the punch and die set shown in FIG. 1, with the high speed stamping press removed for clarity of illustration.
Figure 3:
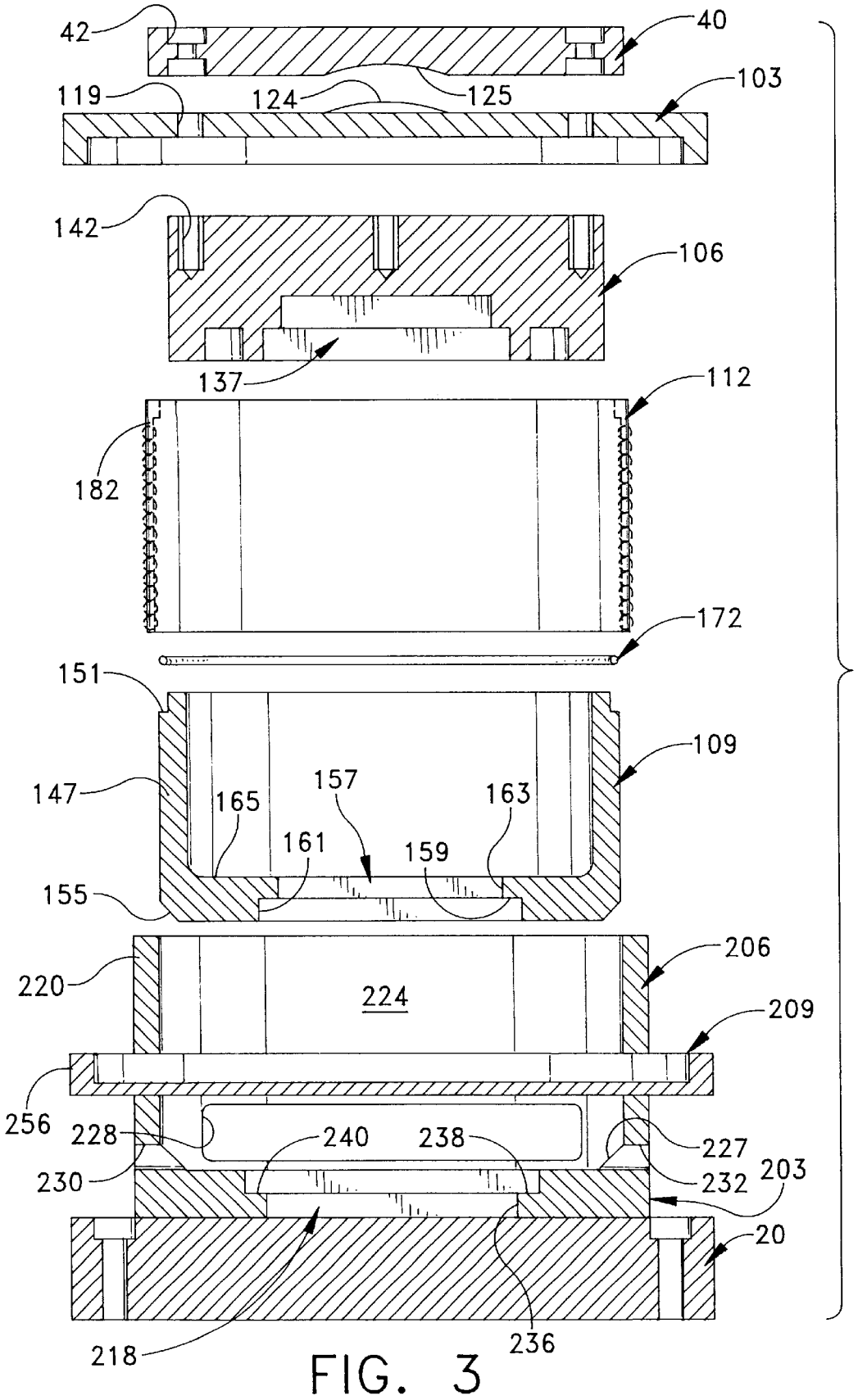
FIG. 3 is an exploded, cross-sectional view of the punch and die set shown in FIG. 2.
Figure 4:
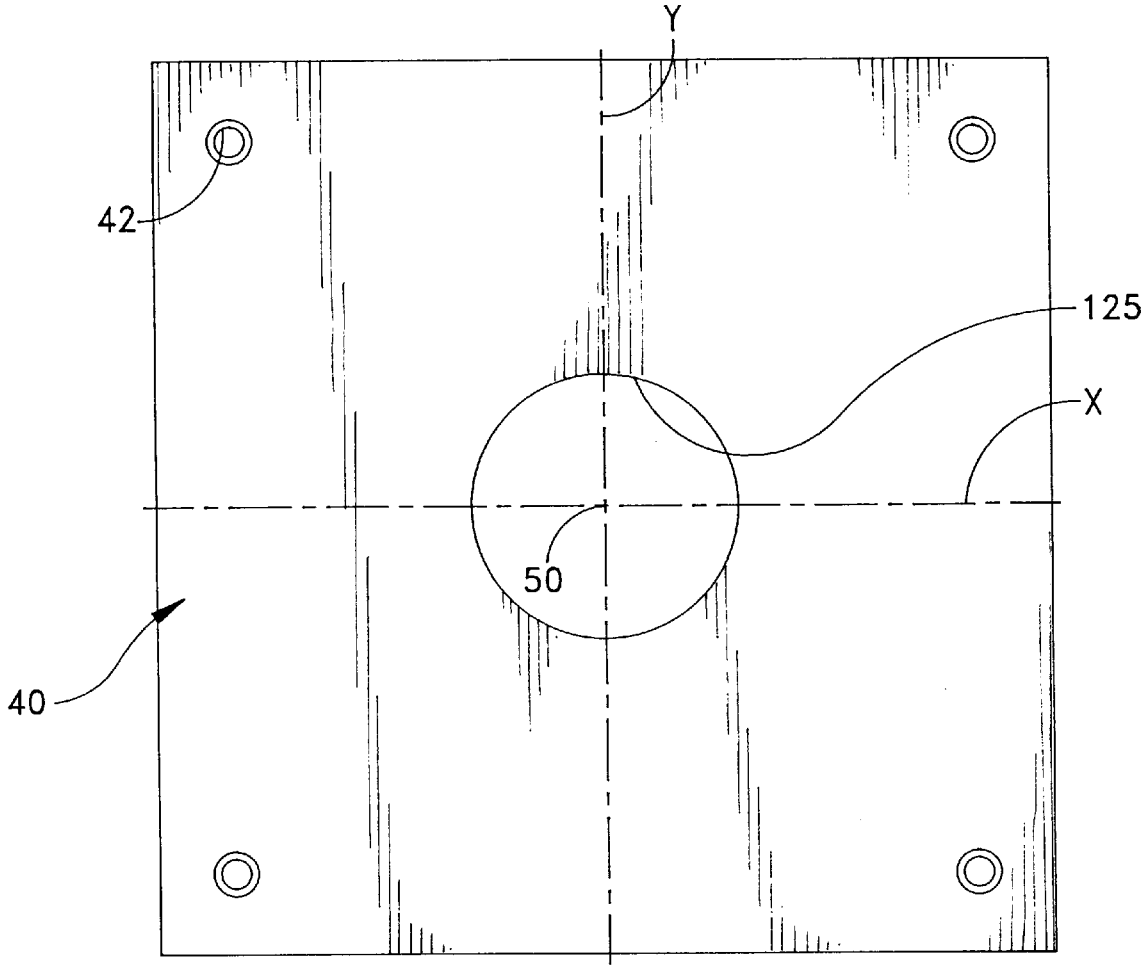
FIG. 4 is a front elevational view of a tooling mount.
Figure 5:
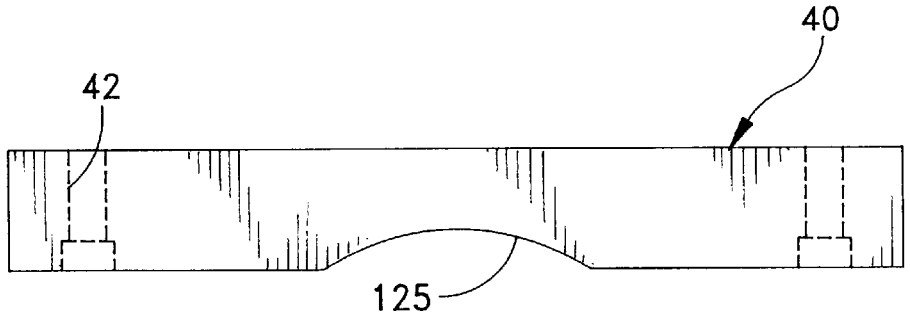
FIG. 5 is a side view, partially in phantom, of the tooling mount shown in FIG. 4.
Figure 6:
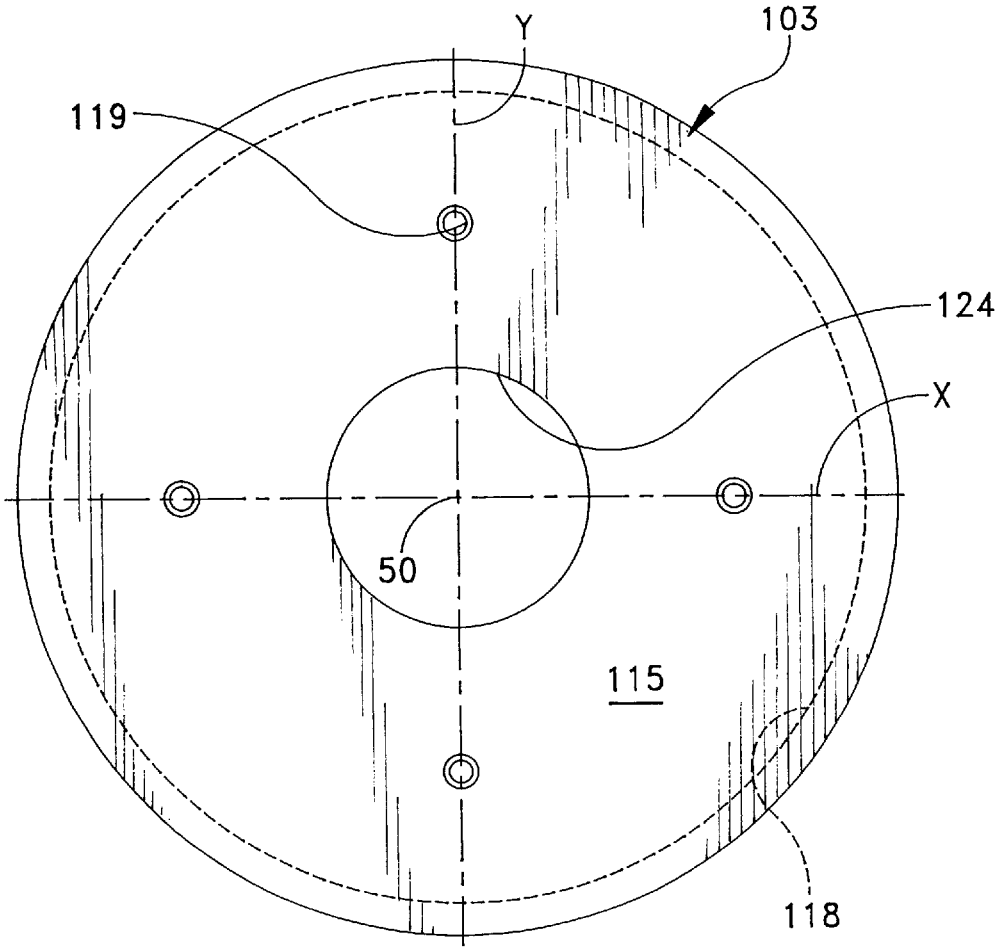
FIG. 6 is a top view of an upper spring retainer.

Referring to FIGS. 1-3, punch and die set 1 comprises a punch assembly 100, a die assembly 200, and a spring 300. Punch assembly 100 is secured to tooling mount 40. Die assembly 200 is secured to bolster plate 20, and spring 300 is interposed between the punch assembly and the die assembly and bears resiliently against them. Preferably, punch assembly 100 and die assembly 200 define a common center 50 (see FIGS. 1 and 2) and axes-of-symmetry X-Y (see FIGS. 4, 6, 8, 10, 13, 15, and 18). In the exemplary embodiment shown such symmetry is circular. Other symmetric relationships between punch assembly 100 and die assembly 200 may be adopted for use with the invention, including, e.g., elliptical, hexagonal, octagonal, or any other shape that provides 360 degrees of bearing surface between punch assembly 100 and die assembly 200.

Punch assembly 100 and die assembly 200 may be formed from any of the well known tool steels or similar, relatively hard and/or durable metals that are well known in the art. A strip of relatively hard metal (not shown) is disposed between the forming tools and die. An indexing mechanism (not shown) is provided to move the strip of metal or other blank or preformed stock through stamping press 10 and to bring the stock between punch assembly 100 and die assembly 200 in a manner that is well known in the art.

Figure 7:
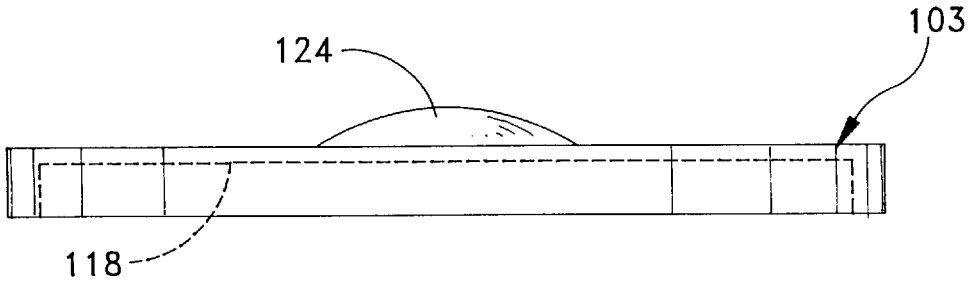
FIG. 7 is a side view, partially in phantom, of the upper spring retainer shown in FIG. 6.

Punch assembly 100 includes an upper spring retainer 103, a punch shoe 106, a stripper guide bushing 109, and a ball cage 112. In the embodiment shown, all conform to a substantially circular symmetry defined about axes of symmetry X-Y passing through punch and die set center axis 50. More particularly, upper spring retainer 103 comprises a generally circular plate having an upper surface 115 and a recessed lower surface 118 projecting radially outwardly from an outer surface of punch shoe 106 (FIG. 7). A ram coupler 124 projects outwardly from a central portion of upper surface 115. Ram coupler 124 is adapted to non-fixedly engage a complementarily shaped recess on tooling mount 40 of ram 15. The engagement is such that the ram can force the tooling mount generally axially downwardly, and limits the axially upward displacement of the tooling mount due to spring 300. However, some relative motion is permitted by the coupling, between the ram and punch assembly 100. Ram coupler 124 may be formed, for example, as a bulbous protrusion such as a chord of a sphere on upper surface 115, and tooling mount 40 may be formed as a complementary recess 125 on ram 15 confronting the protrusion (FIGS. 2, 3, 4–7).

As best shown in FIG. 3, recessed lower surface 118 of upper spring retainer 103 is sized and shaped to receive punch shoe 106. Through-bores 119 communicate between upper surface 115 and recessed lower surface 118, and are adapted to receive fastening means, such as bolts or the like, for affixing spring retainer 103 and punch shoe 106.

Figure 8:
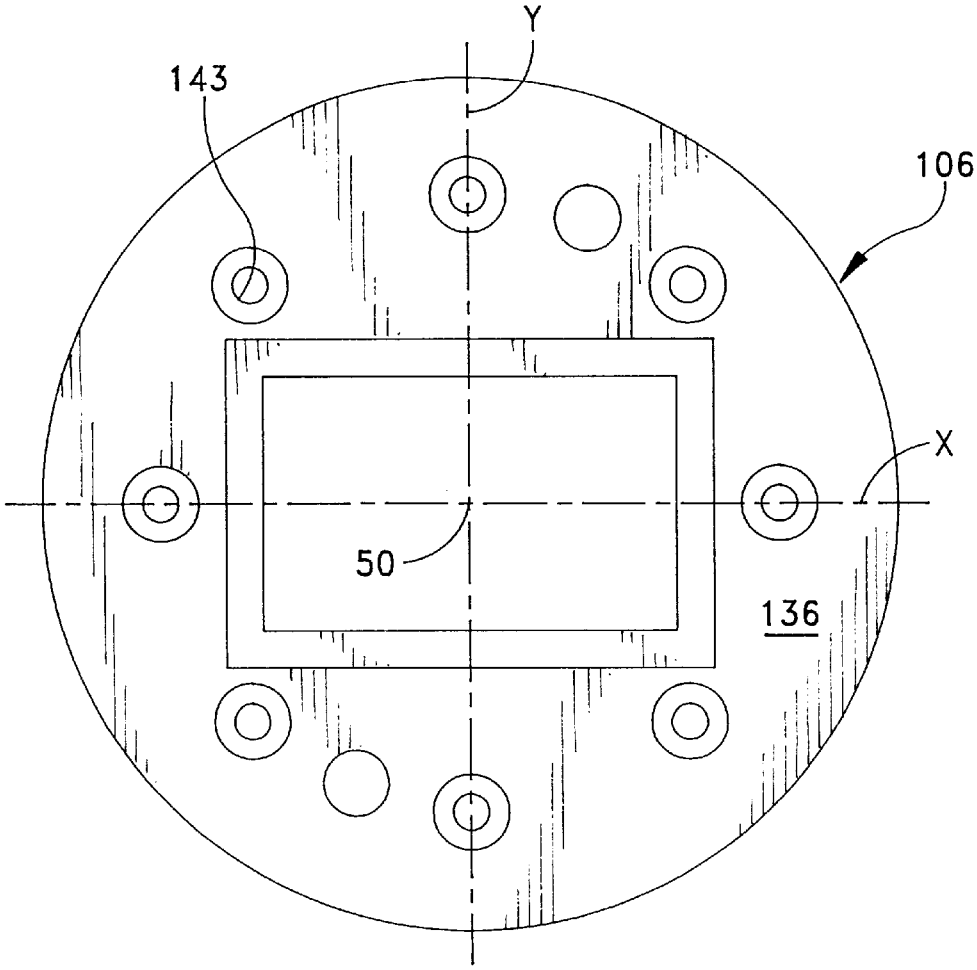
FIG. 8 is a bottom elevational view of a punch shoe formed in accordance with the invention.
Figure 9:
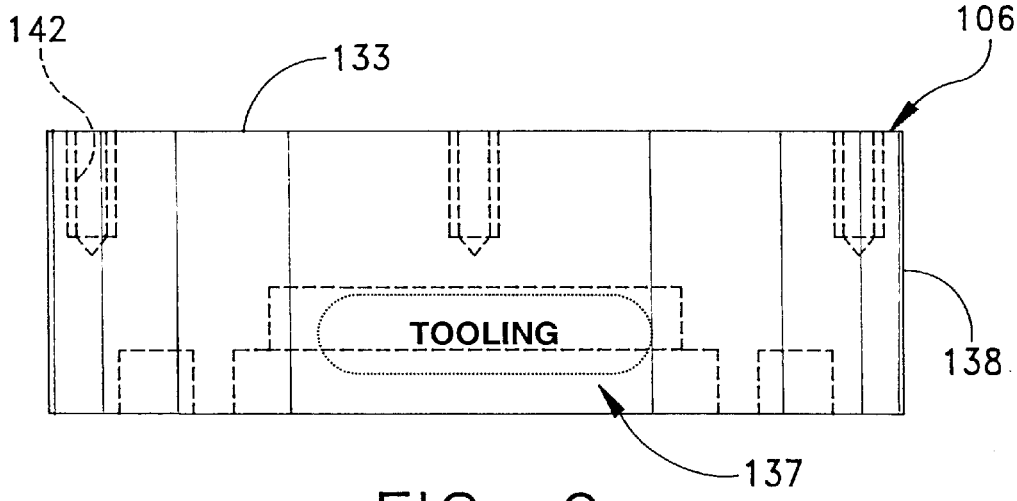
FIG. 9 is a side view, partially in phantom, of the punch shoe shown in FIG. 8.
Figure 10:
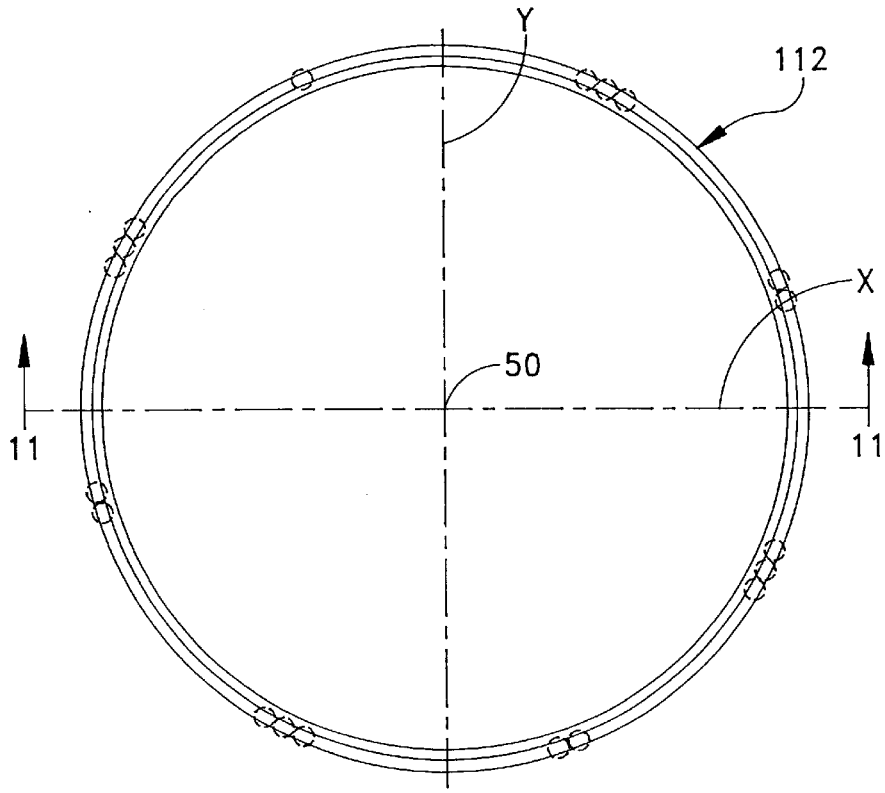
FIG. 10 is a top view of a ball cage.
Figure 11:
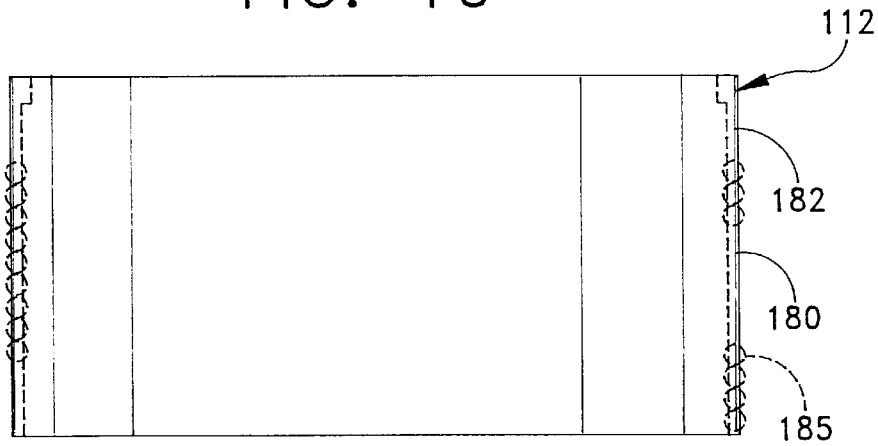
FIG. 11 is a cross-sectional view of the ball cage shown in FIG. 10, as taken along line 11—11 in FIG. 10.
Figure 12:
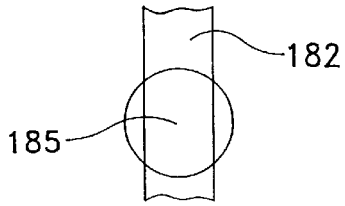
FIG. 12 is a cross-sectional view of a portion of the ball cage shown in FIGS. 10 and 11, showing the relationship of the wall of the ball cage and an individual ball bearing.
Figure 13:
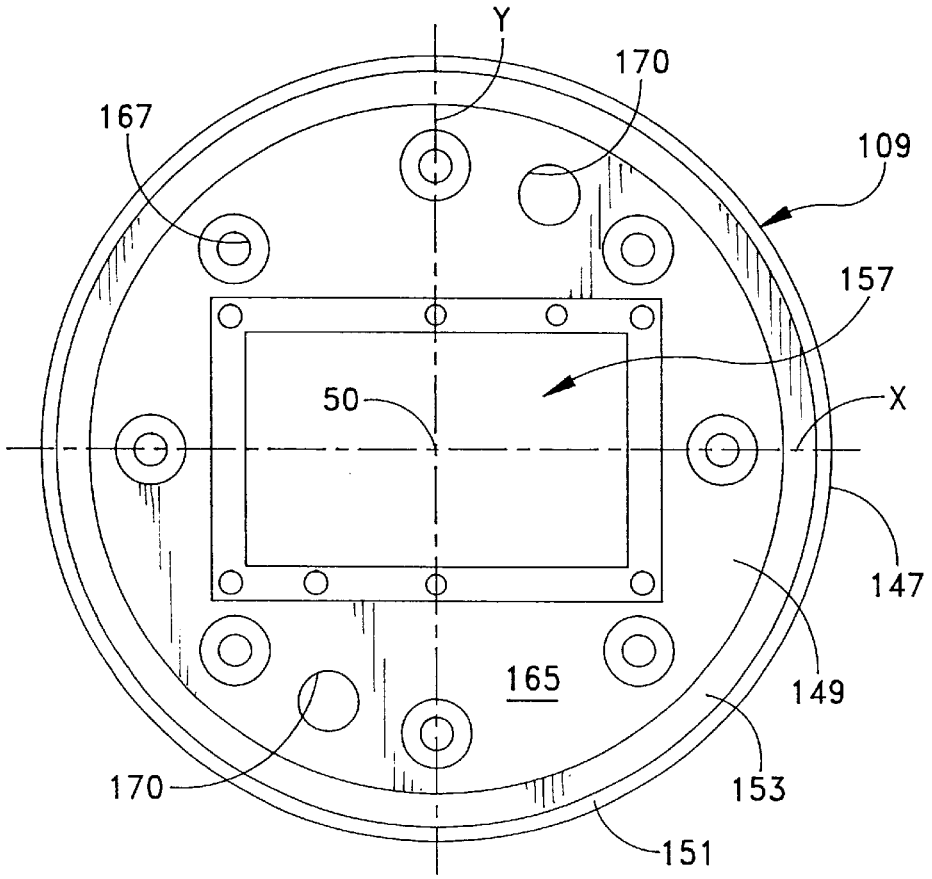
FIG. 13 is a top view of a lower guide bushing formed in accordance with the present invention.
Figure 14:
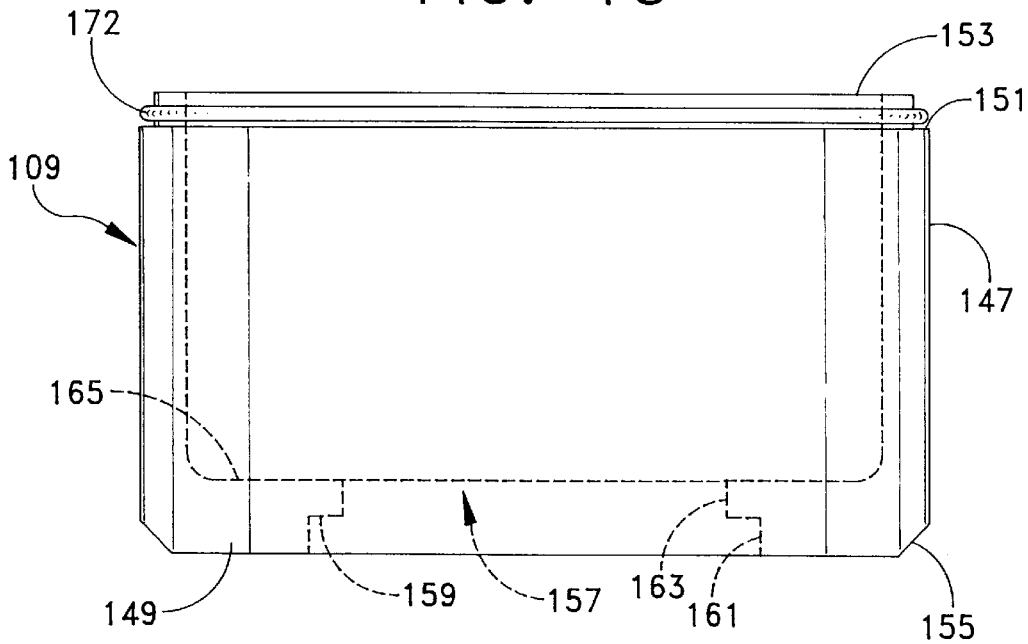
FIG. 14 is a side view, partially in phantom, of the lower guide bushing shown in FIG. 13.
Figure 15:
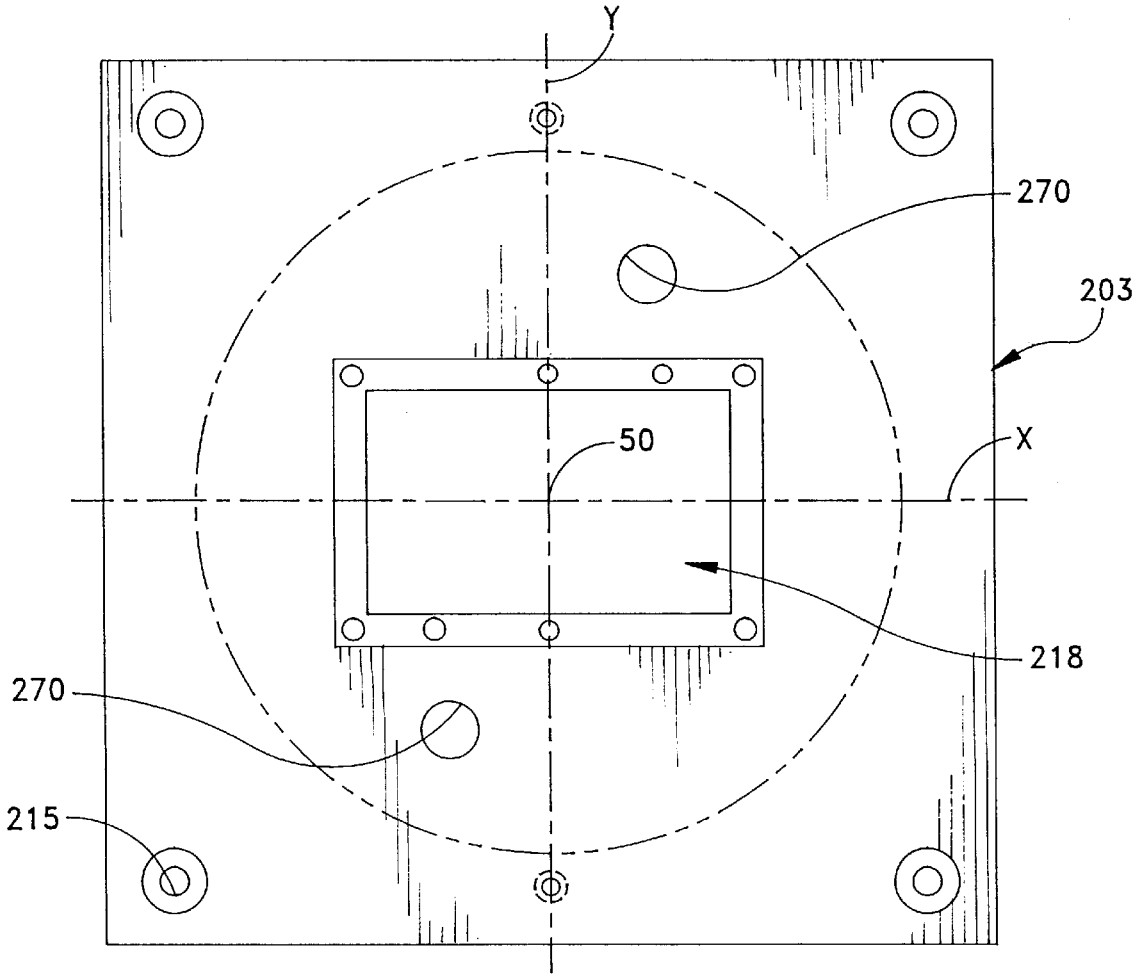
FIG. 15 is a top elevational view of a die nest according to the invention.
Figure 16:
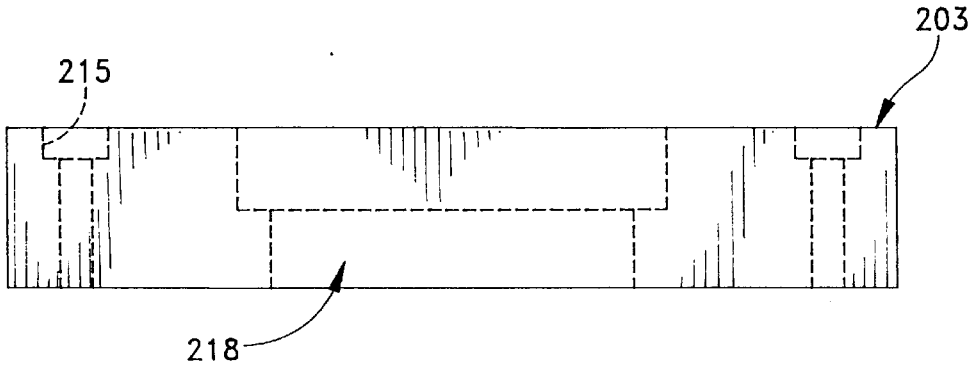
FIG. 16 is a side view, partially in phantom, of the die nest shown in FIG. 15.
Figure 17:
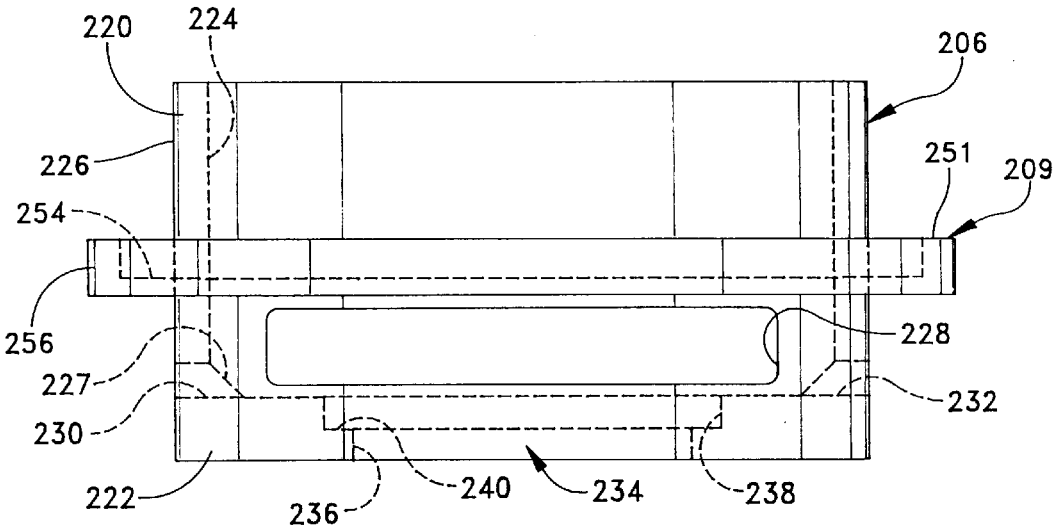
FIG. 17 is a side view of a die shoe according to the invention.

Referring to FIGS. 2, 3, 8, and 9, punch shoe 106 defines an upper surface 133, a lower surface 136, a tooling recess 137, and a side wall 138. Side wall 138 of punch shoe 106 defines a surface of substantially circular symmetry defined about axes of symmetry X-Y passing through center 50. In the embodiment shown, side wall 138 defines a smooth curved surface, namely a circular cylindrical surface, but other shapes are possible as provided herein. Blind bores 142 are located in upper surface 133, and have a depth that is adapted for receiving fastening means, such as, bolts or the like. A plurality of stripper spring bores 143 are formed in lower surface 136, and are adapted to receive a plurality of stripper spring compression sets (not shown). The stripper spring compression sets are known in the art for use in maintaining a stripper plate in position on the metal strip during stamping. Tools (not shown) are fastened, within tooling recess 137 of punch shoe 106 in a predetermined order and pattern. Tooling recess 137 may comprise a polygonal peripheral shape, e.g., rectangular as shown in FIGS. 2, 8, and 9. Tools that are releasably fastened within tooling recess 137 typically include punches and forming tools that are adapted for piercing, drawing, blanking, forming or otherwise displacing selected portions of the metal strip in order to alter its shape, as is well known in the art.

Referring to FIGS. 2, 3, 13, and 14, stripper guide bushing 109 comprises a cylindrically shaped shroud having a curved outer wall 147 and a bottom annular wall 149. Stripper guide bushing 109 also comprises a substantially circular symmetry defined about axes of symmetry X-Y, passing through punch and die set center 50. Outer wall 147 includes an annular recessed shoulder 151 adjacent to a top annular edge 153. The surface of outer wall 147 is substantially smooth as is the inner surface. A chamfered annular corner 155 is disposed about the lower edge of stripper guide bushing 109, at the intersection of outer wall 147 and bottom annular wall 149. Bottom annular wall 149 projects inwardly from the inner surface of outer wall 147 and defines an opening 157 that communicates with the interior of stripper guide bushing 109. Opening 157 is sized and shaped to correspond to tooling recess 137 of punch shoe 106. An internal shoulder 159 is formed between a first annular vertically oriented wall 161 and a second annular vertically oriented wall 163. Inner surface 165 of bottom annular wall 149 comprises a plurality of spring pockets 167 that are adapted to accept conventional compression springs (not shown). In a preferred embodiment, at least 8 spring pockets 167 are circumferentially disposed about opening 157. A pair of anti-rotation bores 170 are defined in bottom annular wall 149 in diametrically opposed, spaced relation to one another. The anti-rotation bores receive corresponding angular anti-rotation pins (not shown) when stripper guide bushing 109 is assembled within punch and die set 1, as will hereinafter be disclosed in further detail. An "O" ring 172 is disposed on shoulder 151 during assembly.

Referring to FIGS. 2, 3, and 10–12, ball cage 112 comprises a cylindrical bushing defined by a cylindrical wall 182 having a plurality of transverse bores 180 disposed throughout its circumference that are sized and shaped to house individual ball bearings 185. Portions of each ball bearing 185 project outwardly from both sides of wall 182. Ball cage 112 has an inner diameter sized to accept stripper guide bushing 109. p Referring to FIGS. 3, 15–18, die assembly 200 comprises a die shoe 203, a die nest guide bushing 206, and a lower spring retainer 209, all having substantially circular symmetry defined about axes X-Y passing through punch and die set center 50. The die nest guide bushing 206, stripper guide bushing 109 and punch shoe 106 are complementary male/female structures, movably carried on one another in a telescopic guiding arrangement, with ball cage 112 reducing friction and wear.

Die shoe 203 comprises means for fixation to bolster plate 20, e.g., through-bores 215 and associated bolts (not shown). A centrally positioned scrap port 218 is formed within die shoe 203. Scrap port 218 provides an exit path for portions of the metal strip that are cut loose by the forming tools located in punch shoe 106. A pair of anti-rotation bores 270 are positioned in die shoe 203 so as to be coaxially aligned with antirotation bores 170 when punch and die set 1 is assembled.

Die nest guide bushing 206 comprises a cylindrically shaped receptacle including a curved outer wall 220 and an annular bottom wall 222. More particularly, curved outer wall 220 comprises an inner surface 224 and an outer surface 226. Annular bottom wall 222 projects inwardly from the lower portion of outer wall 220. The inner diameter of die nest guide bushing 206 is sized to accept stripper guide bushing 109, as will be disclosed in further detail. An annular chamfered corner 227 is formed at the inner intersection of outer wall 220 and bottom wall 222, and is complementary to chamfered corner 155 of stripper guide bushing 109. An access/inspection port 228 is provided in the side of die nest guide bushing 206. Access/inspection port 228 provides a press operator with means for viewing the stamping operation and for accessing tools and/or die shoe 203 for repair or adjustment. A metal strip entrance port 230 and a metal strip exit port 232 are formed in diametrically opposed, coaxially aligned relation to one another within outer wall 220 of die nest guide bushing 206.

Annular bottom wall 222 defines a central opening 234 that is defined by a first annular vertical wall 236 and a second, larger diameter annular vertical wall 238. A shoulder 240 is defined between annular vertical walls 236 and 238. Metal strip exit port 232 allows finished components to exit punch and die set 1, for example to a reeling operation or the like.

Figure 18:
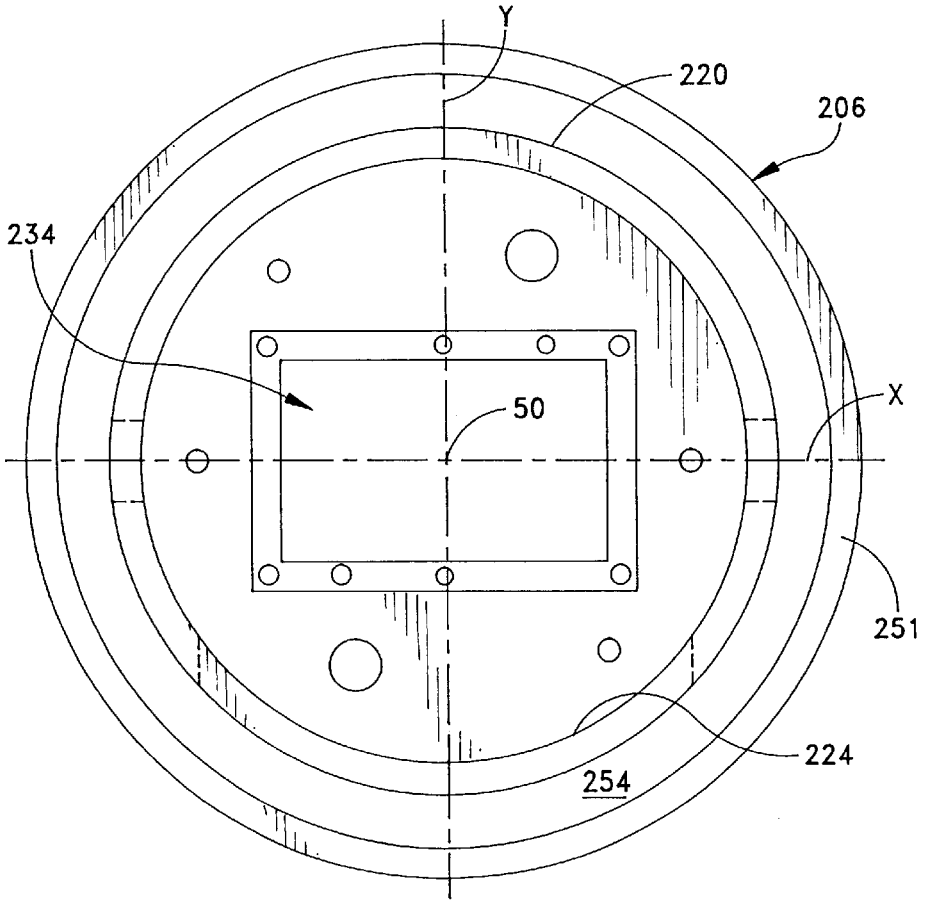
FIG. 18 is a top elevational view, partially in phantom, of the die shoe shown in FIG. 17.

Referring to FIGS. 3, 7, and 18, lower spring retainer 209 comprises an annular plate projecting radially outwardly from outer wall 220 of die nest guide bushing 206, and includes an upper surface 251, a lower surface 254 and an annular wall 256. Lower spring retainer 209 is positioned on outer wall 220 of die nest guide bushing 206, just above access/inspection port 228, and is adapted to support spring 300.

Referring to FIGS. 1 and 2, spring 300 comprises a helically formed rod of spring quality material, e.g., spring steel. Spring 300 is normally biased in compression and comprises an upper ring 310, a lower ring 320, and one or more turns forming a helical beam 330. The diameters of upper ring 310 and lower ring 320 are sized to circumscribe ball cage 112 and die nest guide bushing 206.

Punch assembly 100 and die 200 are assembled in the following manner. Referring to FIGS. 2 and 3, die nest guide bushing 206 is first bolted to die shoe 203 so that scrap port 218 is disposed in coaxial relation with a corresponding scrap part in bolster plate 20. In this position, die nest guide bushing 206 opens upwardly, as best shown in FIG. 3. Once die nest guide bushing 206 is securely fastened to bolster plate 20, die sections, which are the female cutting components that correspond to the tools disposed in punch shoe 106, (not shown for clarity of illustration) are mounted to die nest guide bushing 206, completing the assembly of die assembly 200.

Punch assembly 100 is assembled by first mounting the male cutting components (e.g., pierces, punches, forming tools, etc.) in tooling recess 137 of punch shoe 106. Once this has been completed, a plurality of stripper spring compression sets are mounted within bores 143 of punch shoe 106. A plurality of stripper inserts (not shown, for clarity of illustration) are then mounted to stripper guide bushing 109. Stripper inserts are known in the art for use in removing the pierced metal strip from around the punches, etc., so as to allow the metal strip to advance through the die. Once the stripper inserts have been mounted to stripper guide bushing 109, stripper guide bushing 109 is mounted to punch shoe 106 so as to surround and enclose punch shoe 106. Bolts or the like having a length sufficient to extend through-bores 167 are provided to fasten guide bushing 109 to punch shoe 106. Once this point in the assembly has been reached "O" ring 172 is placed in firm engagement on annular recessed shoulder 151 of stripper guide bushing 109.

Upper spring retainer 103 is mounted to punch shoe 106 by at least one bolt extending through-bore 119 into bore 142. To compete the assembly of punch and die set 1, spring 300 is positioned in lower spring retainer 209 such that lower ring 320 is disposed on lower surface 254. Spring 300 is disposed on lower spring retainer 209 in an initially unbiased condition. Once spring 300 is in position, punch assembly 100 is placed into die assembly 200. As this occurs, angular positioning anti-rotation pins (not shown) are oriented so as to be disposed in anti-rotation bores 170, 270 within stripper guide bushing 109 and die nest guide bushing 206. The angular guide pins and angular guide bushings are known in the art for use in maintaining an appropriate angular orientation between the male and female portions of a punch and die set that are circular in cross section. The pins and bores serve to prevent relative rotation of the circular punch and die and are not provided to guide the punch and die in a longitudinal sense. Longitudinal guidance is provided by the engagement of the punch shoe, stripper guide bushing and die nest guide bushing. The anti-rotation pins and bores also obviously are unnecessary if the punch/die cross section is some shape other than circular. It will be understood that when punch assembly 100 enters die assembly 200, spring 300 will be compressibly biased. In order to maintain punch assembly 100 in position within die assembly 200, it is necessary to lock them in place in order to counteract the biased load exerted by spring 300.

Punch and die set 1 is assembled to high speed stamping press 10 in the following manner. Ram coupler 124 (disposed on upper surface 115 of upper spring retainer 103) is oriented so as to be in confronting relation with complementary recess 125 on ram 15. Punch and die set 1 is first slid along bolster plate 20 of press 10 until tooling mount 40 is disposed in confronting relation with ram 15. Once punch and die set 1 are in position with tooling mount 40 engaging ram coupler 124, punch and die set 1 are releasably fastened to bolster plate 20 by dowel locating pins and securing bolts well known in the art. Once punch and die set 1 are secured, the stamping press 10 is activated so that ram 15 is moved to its full bottom position. Feeler gauges and die down stops (not shown) are used to set the depth of punch tool entry into die sections, as is well known in the art. Once the punch and die section depth settings are established, the lock-up device is removed from spring 300 so that punch assembly 100 is biased against ram 15 by spring 300. Once this has occurred, punch and die set 1 is ready for use to fabricate metal parts.

More particularly, stamping press 10 is activated so as to move ram 15 into a fully top position, which opens punch assembly 100 and die assembly 200 by reducing the biased on spring 300. With a strip of metal fed into die nest guide bushings 206, via entrance support 230, stamping press 10 is activated to move ram 15 into a fully bottom position, firmly holding the strip of metal between the stripper face plate and the die nest. This process is repeated several times with ram 15 reciprocating between a fully bottom position and a fully topped position as a material strip is incrementally slid through the die, where it is progressively formed by the various punch and die tools. The progress of the material through the die may be observed through viewing/access port 228 in die nest guide bushing 206. Adjustments to the tools may also be accomplished via viewing/access port 228, without the need to disassemble punch and die set 1. Once punch and die set 1 has been adjusted to yield satisfactory components, stamping press 10 may be fully activated, for example reciprocating at a rate between 5 and 5,000 strokes per minute while synchronously indexing the stock material into and through the space between the punch and die, to produce parts.

Because of the extreme rigidity and circular symmetry of punch and die set 1, the male cutting components of punch assembly 100 are guided into the female cutting components of die assembly 200 completely dependant upon the guidance provided by stripper guide bushing 109 and die nest guide bushing 206, and completely independent of any inaccuracies inherent in press ram 15 or arises as a function of press ram wear. This system totally eliminates the need for extreme accuracy in the press alignment system. The necessary guidance is provided in the punch, die and stripper mountings. Advantageously, punch and die set 1 are disposed in independent relation to ram 15 since punch and die set 1 are not bolted to ram 15. The linkage between ram 15 and punch and die set 1 shown in the Figures is more forgiving and compensates for press alignment inaccuracies. It will be understood that spring 300 may be replaced by employing spring compression sets located internally to the stripper spring guidance bushings. These internal spring compression sets may be mounted to the punch shoe 106 and act against pockets located in stripper guide bushing 109.

A number of advantages are obtained by employing the present invention, which provides a self-guiding punch and die set which avoids all of the aforementioned problems associated with prior art metal stamping devices. The inventive self-guiding punch and die set reduces misalignment of die components by combining a cage structure of a die with the stripper assembly. The self-guiding punch and die set may be designed and constructed in a simpler fashion than punch/die arrangements having other mounting and guidance arrangements, combining the functions of the ball cage die structure with the stripper assembly. The inventive structure has fewer components subject to failure, and the components are more integral and therefore durable than more complex arrangements and are characterized by less expensive up-front acquisition costs.

One substantial advantage of the invention is that the self-guiding punch and die set as disclosed provides an independent alignment system which allows practical use of older, worn and less reliable stamping presses in the production of precision parts, without a corresponding reduction in the quality of the manufactured part. Old stamping press equipment may be utilized with the self-guiding punch and die set of the present invention without the expense of procuring new portions of the press to replace worn ones that admit of looseness or displacement of the ram, or otherwise repairing the worn press. This allows the design of a totally new type of simplified press that does not require the complex drive and controls of existence presses and the maintenance to the way and gibb alignment system.

The invention is by no means limited to the precise constructions specifically disclosed and shown in the drawings, but also encompasses modifications or equivalents within the scope of the appended claims.

What is claimed is:

1. A self-guiding punch and die set for forming metal parts, comprising: a punch assembly having:

a punch shoe including a first side and a second side operatively engaged by a portion of a stamping press on said second side, said first and second sides being referenced to a common center, said punch shoe to hold at least one tool a stripper guide bushing comprising a cylindrical outer wall having an inner surface, an outer surface and a bottom annular wall projecting radially inwardly from said inner surface so as to define a central opening dimensioned to permit passage of said at least one tool and such that said stripper guide bushing is disposed in surrounding and enclosing relation to said punch shoe wherein said punch shoe and said stripper guide bushing are formed so as to be symmetric about said common center; and a die assembly having a die shoe aligned with and confronting said punch shoe, including a die nest having at least one through-bore; and, die nest guide bushing disposed in surrounding and enclosing relation to said die nest, wherein said die nest guide bushing is symmetric about said common center and is dimensioned larger than said punch shoe and said stripper guide bushing, such that when said stamping press is actuated, said die nest guide bushing slidingly receives and guides said punch shoe and said stripper guide bushing around a full periphery of said punch shoe and said stripper guide bushing during substantially a full stroke of said stamping press. and the die shoe during at least a portion of a stroke of said stamping press.

2. The punch and die set according to claim 1, further comprising means for biasing said punch assembly and said die assembly away from one another, said means for biasing opposing relative advance of the punch shoe and a die assembly having the die shoe during at least a portion of a stroke of said press.

3. The punch and die set according to claim 2, wherein said means for biasing said punch assembly and said die assembly away from one another comprises at least one helical compression spring between said punch assembly and said die assembly.

4. The punch and die set according to claim 3, further comprising an upper spring retainer having an upper surface and a recessed lower surface and projecting outwardly from a peripheral surface of said punch shoe and adapted to maintain said helical spring in surrounding relation to said punch assembly and said die assembly.

5. The punch and die set according to claim 3, further comprising a lower spring retainer having an upper surface and a recessed lower surface and projecting outwardly from a peripheral surface of said die shoe, the lower spring retainer being adapted to maintain said helical spring in surrounding relation to said punch assembly and said die assembly.

6. The punch and die set according to claim 1 operatively positioned within a stamping press that includes a ram adapted for transferring reciprocating motion to said punch shoe, and further comprising a ram coupler comprising a bulbous protrusion projecting outwardly from an upper surface of said punch shoe and said ram includes a tooling mount defining a complementary confronting recess adapted to non-fixedly engage said bulbous protrusion.

7. The punch and die set according to claim 1, wherein said punch shoe has substantially a circular symmetry.

8. The punch and die set according to claim 1, wherein said stripper guide bushing has substantially a circular symmetry.

9. The punch and die set according to claim 1, wherein said outer wall of said stripper guide bushing includes an annular recessed shoulder positioned adjacent to a top annular edge, and the outer and inner surfaces of said outer wall are substantially smooth with a chamfered annular corner disposed about a lower edge at an intersection of said outer wall and said bottom annular wall.

10. The punch and die set according to claim 1, further comprising a ball cage having a hollow cylindrical wall including a plurality of bores, each sized and shaped to house a ball bearing, portions of each said ball bearing projecting outwardly from both sides of said cylindrical wall, wherein said ball cage has an inner diameter that is sized to surround and enclose said stripper guide bushing.

11. The punch and die set according to claim 1, wherein said a die shoe has substantially a circular symmetry.

12. The punch and die set according to claim 11, wherein said die shoe comprises a cylindrical shape having a curved outer wall and a bottom annular wall.

13. The punch and die set according to claim 11, wherein said die nest guide bushing comprises a cylindrically shaped receptacle including a curved outer wall and an annular bottom wall.

14. The punch and die set according to claim 13, wherein said curved outer wall of said die nest guide bushing comprises an inner surface and an outer surface, and wherein said annular bottom wall of said die nest guide bushing projects inwardly from a lower portion of said outer wall of said die nest guide bushing such that an inner diameter of said die nest guide bushing is sized to receive said stripper guide bushing.

15. The punch and die set according to claim 14, further comprising an annular chamfered corner formed at an inner intersection of said outer wall and said bottom wall of said die nest guide bushing, which is complementary to a chamfered corner of said stripper guide bushing.

16. The punch and die set according to claim 13, wherein an access/inspection port is provided in said outer wall of said die nest guide bushing.

17. The punch and die set according to claim 13, wherein a work piece entrance port and a work piece exit port are provided in diametrically opposed relation to one another within said outer wall of said die nest guide bushing.

18. The punch and die set according to claim 1, further comprising a lower spring retainer having an annular plate projecting radially outwardly from an outer wall of said die nest guide bushing, and including an upper surface, a lower surface and an annular wall.

19. A self-guiding punch and die set for use in a stamping press, comprising:

a punch assembly including a punch shoe having a first side and a second side operatively engaged by a portion of a stamping press on said second side, said first and second sides being referenced to a common center, said punch shoe adapted to hold at least one tool; and, a stripper guide bushing comprising a cylindrical outer wall having an inner surface and a bottom annular wall projecting radially inwardly from said inner surface so as to define a central opening dimensioned to permit passage of said at least one tool and such that said stripper guide bushing envelopes and surrounds said punch shoe wherein said punch shoe and said stripper guide bushing are circularly symmetric about said first and second side centers; and, a die assembly including a die nest having a cylindrical guide bushing having an inner diameter that is larger than an outer diameter of said punch shoe and said stripper guide bushing and with said die nest positioned in the die assembly such that said cylindrical guide bushing slidingly received and guides said punch shoe and said stripper guide bushing, said stripper guide bushing bearing against said punch shoe around a full periphery thereof for guiding the punch shoe relative to the die nest during a full stroke of said stamping press.

20. A self-guiding punch and die set for forming metal parts, comprising:

a punch shoe including a first side and a second side operatively engaged by a portion of a stamping press on said second side, said first and second sides being referenced to a common center, said punch shoe adapted to hold at least one tool;

a stripper guide bushing comprising a cylindrical outer wall having an inner surface and a bottom annular wall projecting radially inwardly from said inner surface so as to define a central opening dimensioned to permit passage of said at least one tool and such that said stripper guide bushing is disposed in surrounding and enclosing relation to said punch shoe wherein said punch shoe and said stripper guide bushing are formed so as to be symmetric about said common center;

a ball cage comprising a cylindrical wall having a plurality of through holes and an inner diameter;

a plurality of balls positioned within said holes and together defining an outer diameter of said ball cage that is greater than said inner diameter, wherein said ball cage is positioned in surrounding and slidingly engaging relation to said cylindrical outer wall of said stripper guide bushing;

a die shoe aligned with and confronting said punch shoe, including a die nest having at least one through-bore; and, a cylindrical die nest guide bushing having an outer surface and disposed in surrounding and enclosing relation to said die nest, wherein said die nest guide bushing is symmetric about said common center and is dimensioned larger than said inner diameter and smaller than said outer diameter of said ball cage such that when said stamping press is actuated, said die nest guide bushing slidingly receives and guides said punch shoe and said stripper guide bushing around a full periphery of said punch shoe and said stripper guide bushing during substantially a full stroke of said stamping press.

* * * * *